US006425266B1

(12) United States Patent
Roberts

(10) Patent No.: US 6,425,266 B1
(45) Date of Patent: Jul. 30, 2002

(54) LOW TEMPERATURE HYDROCARBON GAS SEPARATION PROCESS

(75) Inventor: Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/962,755

(22) Filed: Sep. 24, 2001

(51) Int. Cl.[7] ..... F25J 3/00
(52) U.S. Cl. ..... 62/621
(58) Field of Search ..... 62/617, 618, 619, 62/620, 621, 901

(56) References Cited

U.S. PATENT DOCUMENTS

| | | | | |
|---|---|---|---|---|
| 3,702,541 A | | 11/1972 | Randall et al. | 62/26 |
| 4,061,481 A | | 12/1977 | Campbell et al. | 62/29 |
| 4,157,904 A | | 6/1979 | Campbell et al. | 62/27 |
| 4,203,741 A | | 5/1980 | Bellinger et al. | 62/24 |
| 4,519,824 A | | 5/1985 | Huebel | 62/24 |
| 4,657,571 A | * | 4/1987 | Gazzi | 62/17 |
| 4,687,499 A | | 8/1987 | Aghili | 62/24 |
| 4,854,955 A | | 8/1989 | Campbell et al. | 62/24 |
| 4,869,740 A | | 9/1989 | Campbell et al. | 52/24 |
| 4,889,545 A | | 12/1989 | Campbell et al. | 62/24 |
| 5,215,629 A | * | 6/1993 | Skatulla et al. | 203/22 |
| 5,275,005 A | | 1/1994 | Campbell et al. | 62/24 |
| 5,555,748 A | | 9/1996 | Campbell et al. | 62/621 |
| 5,566,554 A | | 10/1996 | Vijayaraghavan et al. | 62/621 |
| 5,568,737 A | | 10/1996 | Campbell et al. | 62/621 |
| 5,799,507 A | | 9/1998 | Wilkinson et al. | 62/621 |
| 5,881,569 A | | 3/1999 | Campbell et al. | 62/621 |
| 5,890,378 A | | 4/1999 | Rambo et al. | 62/621 |
| 5,953,935 A | | 9/1999 | Sorensen | 62/621 |
| 5,960,644 A | * | 10/1999 | Nagelvoort et al. | 62/622 |
| 5,983,664 A | | 11/1999 | Campbell et al. | 62/621 |
| 6,311,516 B1 | * | 11/2001 | Key et al. | 62/619 |

* cited by examiner

*Primary Examiner*—Denise L. Esquivel
*Assistant Examiner*—Malik N. Drake
(74) *Attorney, Agent, or Firm*—John M. Fernbacher

(57) ABSTRACT

Method for separating a pressurized hydrocarbon mixture containing at least a more volatile component and a less volatile component. The method comprises (a) cooling and partially condensing the hydrocarbon mixture to yield a first hydrocarbon vapor and a first hydrocarbon liquid; (b) work expanding at least a portion of the first hydrocarbon vapor and introducing it into a distillation column at a first column location; (c) reducing the pressure of the first hydrocarbon liquid and introducing it into the distillation column at a second column location; and (d) withdrawing an overhead vapor enriched in the more volatile component from the distillation column; cooling, partially condensing, and separating the overhead vapor to provide a condensed overhead liquid and an uncondensed vapor overhead, introducing the condensed overhead liquid into the distillation column as reflux, and withdrawing from the bottom of the distillation column a stream enriched in the less volatile component. Cooling and partial condensing of the overhead vapor in (d) may be effected by (1) further cooling a second portion of the two-phase hydrocarbon mixture, (2) reducing the pressure of the further cooled hydrocarbon mixture to provide a reduced-pressure hydrocarbon mixture; and (3) cooling and partially condensing the overhead vapor by indirect heat exchange with the reduced-pressure hydrocarbon mixture to provide reflux to the distillation column. Cooling and partial condensing of the overhead vapor provides a warmed, two-phase hydrocarbon mixture, the warmed, two-phase hydrocarbon mixture may be separated into a second hydrocarbon liquid and a second hydrocarbon vapor, the second hydrocarbon liquid may be introduced into the distillation column, and the second hydrocarbon vapor may be warmed and introduced in to the distillation column at a second location below the first column location of (b).

16 Claims, 5 Drawing Sheets

LOW TEMPERATURE HYDROCARBON GAS SEPARATION PROCESS

BACKGROUND OF THE INVENTION

The separation of hydrocarbon gas mixtures is a common and energy-intensive process in the petroleum refining, natural gas, and petrochemical industries. These mixtures commonly contain methane and heavier hydrocarbons having up to six carbon atoms, and also may contain low concentrations of non-hydrocarbons such as hydrogen, nitrogen, and carbon dioxide. Such gas mixtures include refinery gas streams, raw natural gas, and offgas streams generated in the conversion of heavier hydrocarbons to lighter products.

These hydrocarbon mixtures often are available at elevated pressures up to 1000 psia or higher. A widely-used process for recovering $C_2$ and heavier hydrocarbons from such mixtures involves low temperature fractionation in which a major portion of the required refrigeration is provided by work expansion of pressurized process streams. The autorefrigeration provided by this work expansion may be supplemented by external closed-cycle refrigeration systems using propane, freon, or other working refrigerants.

One such method for recovering light hydrocarbons from mixtures of methane and light hydrocarbons is described in U.S. Pat. No. 4,854,955 wherein an expander process is utilized in which a pressurized feed gas is cooled and partially condensed by heat exchange with returning cold process streams. A portion of the partially-condensed, two-phase feed is separated into a vapor stream and a liquid stream, the vapor stream is cooled by work expansion, and the expanded stream is introduced as a main feed into a low temperature distillation column. The liquid stream is introduced as another main feed into the distillation column. Refrigeration for reflux of the distillation column is provided by further cooling and condensing of another portion of the partially-condensed, two-phase feed, flashing this further cooled stream, and vaporizing a portion of the flashed liquid in the reflux overhead condenser. Partially vaporized feed from the condenser is introduced into the upper portion of the distillation column, above the locations of the main feed streams. Light overhead gas rich in methane is compressed to provide a light gas product and a bottoms product stream enriched in $C_2^+$ hydrocarbons is withdrawn from the column.

A related process is disclosed in U.S. Pat. No. 4,889,545 in which a portion of the distillation column overhead vapor is compressed and condensed at an elevated pressure against the vaporizing flashed two-phase feed in a reflux condenser. The condensed overhead is flashed and returned as reflux to the column, and the partly vaporized feed from the condenser is introduced into the upper portion of the distillation column.

Both of the processes described above introduce a significant amount of vapor into the upper portion or rectification section of the distillation column above the locations of the main feed streams. This high vapor loading vapor can have a detrimental effect on the separation efficiency in the rectification section of the column.

The invention disclosed below offers an improved process for light hydrocarbon separation which reduces the vapor load on the rectification section of the distillation column, thereby allowing column operation at higher pressures, reducing reflux condenser duty, and decreasing total power requirements.

BRIEF SUMMARY OF THE INVENTION

The invention relates to a method for the separation of a pressurized hydrocarbon mixture containing at least one more volatile component and at least one less volatile component. In one embodiment, the method comprises (a) cooling and partially condensing the hydrocarbon mixture to form a two-phase hydrocarbon mixture, and separating a first portion of the two-phase hydrocarbon mixture into a first hydrocarbon vapor and a first hydrocarbon liquid;

(b) work expanding at least a portion of the first hydrocarbon vapor to provide a cooled, expanded hydrocarbon vapor and introducing the cooled, expanded hydrocarbon vapor into a distillation column at a first column location;

(c) reducing the pressure of the first hydrocarbon liquid to provide a reduced-pressure hydrocarbon liquid and introducing the reduced-pressure hydrocarbon liquid into the distillation column at a second column location; and (d) withdrawing an overhead vapor enriched in the more volatile component from the distillation column; cooling, partially condensing, and separating the overhead vapor to provide a condensed overhead liquid and an uncondensed vapor overhead, introducing the condensed overhead liquid into the distillation column as reflux, and withdrawing from the bottom of the distillation column a stream enriched in the less volatile component.

The cooling and partial condensing of the overhead vapor in (d) may be effected by (1) further cooling a second portion of the two-phase hydrocarbon mixture to provide a further cooled hydrocarbon mixture;

(2) reducing the pressure of the further cooled hydrocarbon mixture to provide a reduced-pressure hydrocarbon mixture; and (3) utilizing the reduced-pressure hydrocarbon mixture to provide by indirect heat exchange the cooling and partial condensing of the overhead vapor.

In addition, cooling and partial condensing of the overhead vapor by indirect heat exchange with the reduced-pressure hydrocarbon mixture in (3) may provide a warmed, two-phase hydrocarbon mixture, the warmed, two-phase hydrocarbon mixture may be separated into a second hydrocarbon liquid and a second hydrocarbon vapor, the second hydrocarbon liquid may be introduced into the distillation column, and the second hydrocarbon vapor may be warmed and introduced into the distillation column at a third column location below the first column location of (b).

The cooling of the second portion of the two-phase hydrocarbon mixture of (1) may be effected in part by indirect heat exchange with the second hydrocarbon vapor to provide a warmed second hydrocarbon vapor. The cooling and partial condensing of the hydrocarbon mixture in (a) may be effected in part by indirect heat exchange with the warmed second hydrocarbon vapor to yield a further warmed second hydrocarbon vapor which is introduced into the distillation column at the third column location which is below the first column location of (b). The third column location may be below the second column location.

In another embodiment, a portion of the first hydrocarbon vapor of (a) may be combined with the second portion of the two-phase hydrocarbon mixture of prior to further cooling.

The cooling of the second portion of the two-phase hydrocarbon mixture of (1) may be effected in part by indirect heat exchange with the uncondensed vapor overhead of (d) to provide a warmed uncondensed vapor overhead. The cooling and partially condensing of the hydrocarbon mixture in (a) may be effected in part by indirect heat exchange with the warmed uncondensed vapor overhead.

The overhead vapor enriched in the more volatile component withdrawn from the distillation column in (d) may be compressed prior to cooling and partially condensing, and the partially-condensed overhead may be reduced in pressure prior to introduction into the distillation column as reflux.

If desired, the second hydrocarbon vapor may be work expanded after warming and prior to introduction into the distillation column.

The pressure of the reduced-pressure hydrocarbon mixture of (2) may be lower than the pressure in the distillation column. The second hydrocarbon liquid may be pumped and pressurized prior to introduction into the distillation column. The second hydrocarbon vapor may be compressed prior to being introduced into the distillation column.

The hydrocarbon mixture may comprise methane and one or more hydrocarbons containing two or more carbon atoms. The hydrocarbon mixture also may contain nitrogen, and the hydrocarbon mixture may be natural gas.

In an alternative embodiment, the invention relates to a method for the separation of a pressurized hydrocarbon mixture containing at least one more volatile component and at least one less volatile component. The method of the alternative embodiment comprises (a) cooling and partially condensing the hydrocarbon mixture to form a two-phase hydrocarbon mixture, and separating a first portion of the two-phase hydrocarbon mixture into a first hydrocarbon vapor and a first hydrocarbon liquid;

(b) work expanding at least a portion of the first hydrocarbon vapor to provide a cooled, expanded hydrocarbon vapor and introducing the cooled, expanded hydrocarbon vapor into a distillation column at a first column location;

(c) reducing the pressure of the first hydrocarbon liquid to provide a reduced-pressure hydrocarbon liquid and introducing the reduced-pressure hydrocarbon liquid into the distillation column at a second column location; and (d) withdrawing an overhead vapor enriched in the more volatile component from the distillation column, compressing a portion of the overhead vapor to yield a compressed overhead vapor, cooling the compressed overhead vapor to provide a cooled and at least partially condensed overhead stream, reducing the pressure of the cooled and at least partially condensed overhead stream to provide a reduced-pressure overhead stream, introducing the reduced-pressure overhead stream into the distillation column as reflux, and withdrawing from the bottom of the distillation column a stream enriched in the less volatile component.

The cooling of the compressed overhead vapor in (d) may be effected by (1) further cooling a second portion of the two-phase hydrocarbon mixture to provide a further cooled hydrocarbon mixture;

(2) reducing the pressure of the further cooled hydrocarbon mixture to provide a reduced-pressure hydrocarbon mixture; and (3) utilizing the reduced-pressure hydrocarbon mixture to provide by indirect heat exchange the cooling of the compressed overhead vapor.

The cooling of the compressed overhead vapor by indirect heat exchange with the reduced-pressure hydrocarbon mixture in (3) may provide a warmed, two-phase hydrocarbon mixture, the warmed, two-phase hydrocarbon mixture may be separated into a second hydrocarbon liquid and a second hydrocarbon vapor, the second hydrocarbon liquid may be introduced into the distillation column, and the second hydrocarbon vapor may be warmed and introduced into the distillation column at a third column location below the first column location of (b).

DETAILED DESCRIPTION OF THE INVENTION

The present invention relates to the separation of light hydrocarbons by autorefrigeration and distillation in which the vapor load to the rectification section of the distillation column can be reduced by warming a portion of the condensed feed and introducing the warmed feed portion into the lower portion or stripping section of the column.

Figure 1:
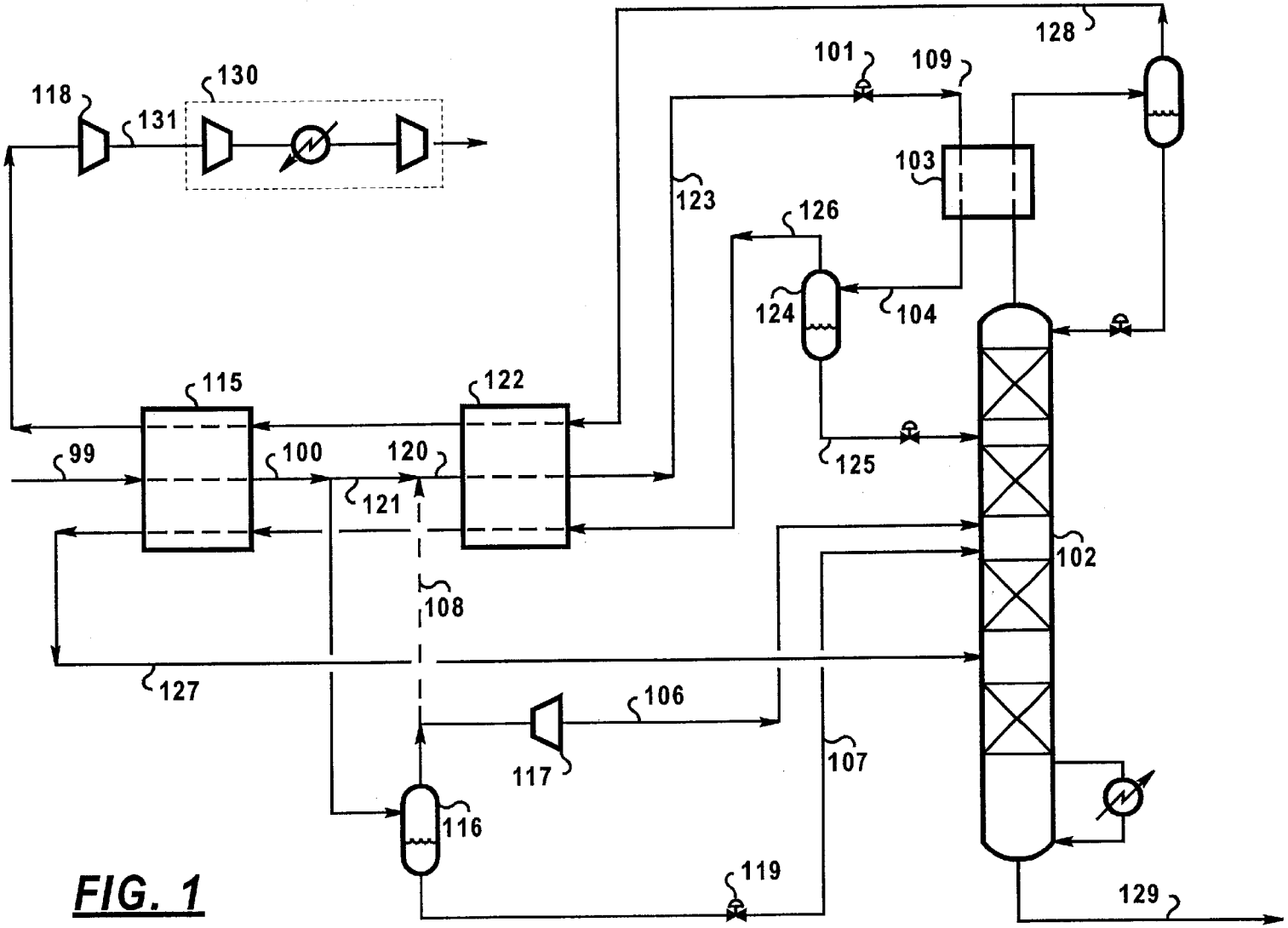
FIG. 1 is a schematic flow diagram of an exemplary embodiment of the present invention for light hydrocarbon separation.

An exemplary embodiment of the invention is illustrated in FIG. 1 by a process for recovering $C_3^+$ liquids from natural gas. This embodiment is especially useful for maximizing propane recovery with high methane rejection. Feed stream 99, a natural gas stream typically at 600–1500 psia and ambient temperature, is cooled and partially condensed in heat exchanger 115 by indirect heat exchange with cold process streams (later defined). A major portion of partially condensed stream 100 is directed to separator 116 and separated into liquid and vapor streams. Some or all of this vapor stream is work expanded in turboexpander 117, and the resulting cooled, expanded stream 106 is introduced as a first main feed into distillation column 102. The liquid from separator 116 is reduced in pressure across valve 119 to yield reduced pressure stream 107, which is introduced as a second main feed stream 107 into distillation column 102. Optionally, stream 107 can be partly vaporized (not shown) before introduction into distillation column 102 to provide additional cooling to the feed stream 99.

A portion 121 of stream 100 optionally may be combined with portion 108 of the vapor from separator 116 to form stream 120. Alternatively, stream 120 may be formed exclusively by portion 121 of stream 100. In another alternative, stream 120 may be formed exclusively by stream 108, with all of stream 100 passing to separator 116. Thus stream 120 may be formed exclusively from stream 121, exclusively from stream 108, or from combined streams 121 and 108.

Stream 120 is further cooled and condensed in heat exchanger 122 by indirect heat exchange with cold process streams (later defined) to provide stream 123. Stream 123 is flashed across valve 101 to a pressure slightly above the pressure of distillation column 102 to provide stream 109, which is partially vaporized in heat exchanger 103 to provide refrigeration necessary to generate reflux for distillation column 102. The resulting two-phase stream 104 is separated in separator 124 to yield liquid stream 125 and vapor stream 126. Liquid stream 125 is fed into the rectification section of distillation column 102 at an intermediate location above the main feed stream 106 to the column. Vapor stream 126 is warmed in heat exchangers 122 and 115 to recover its refrigeration, thereby providing a portion of the cooling for feed stream 99 and stream 120 described earlier. Stream 126 may be warmed to a temperature greater than −50° F. and preferably to a temperature greater than 0° F. The resulting warmed vapor stream 127 is introduced into the stripping section of distillation column 102 at a location below main feed streams 106 and 107. Distillation column 102 uses a bottom reboiler as shown, and may use additional intermediate reboilers (not shown) to improve efficiency.

Distillation column 102 fractionates feed streams 106, 107, 125, and 127 to yield light overhead vapor stream 128, which is enriched in methane, and liquid bottoms stream 129, which contains the bulk of the $C_3^+$ hydrocarbons in feed stream 99.

Overhead vapor stream 128 is warmed to near ambient temperature through heat exchangers 122 and 115 to provide additional cooling for streams 99 and 120. The warmed vapor is compressed in compressor 118, which may be driven (not shown) by expander 117. The resulting compressed stream 131 is further compressed in compression system 130 for introduction to a pipeline or a downstream process.

Distillation column 102 may operate in a pressure range of about 200 to 700 psia. Mass transfer devices in distillation column 102 may be trays, structured packing, or combinations of trays and packing.

Figure 2:
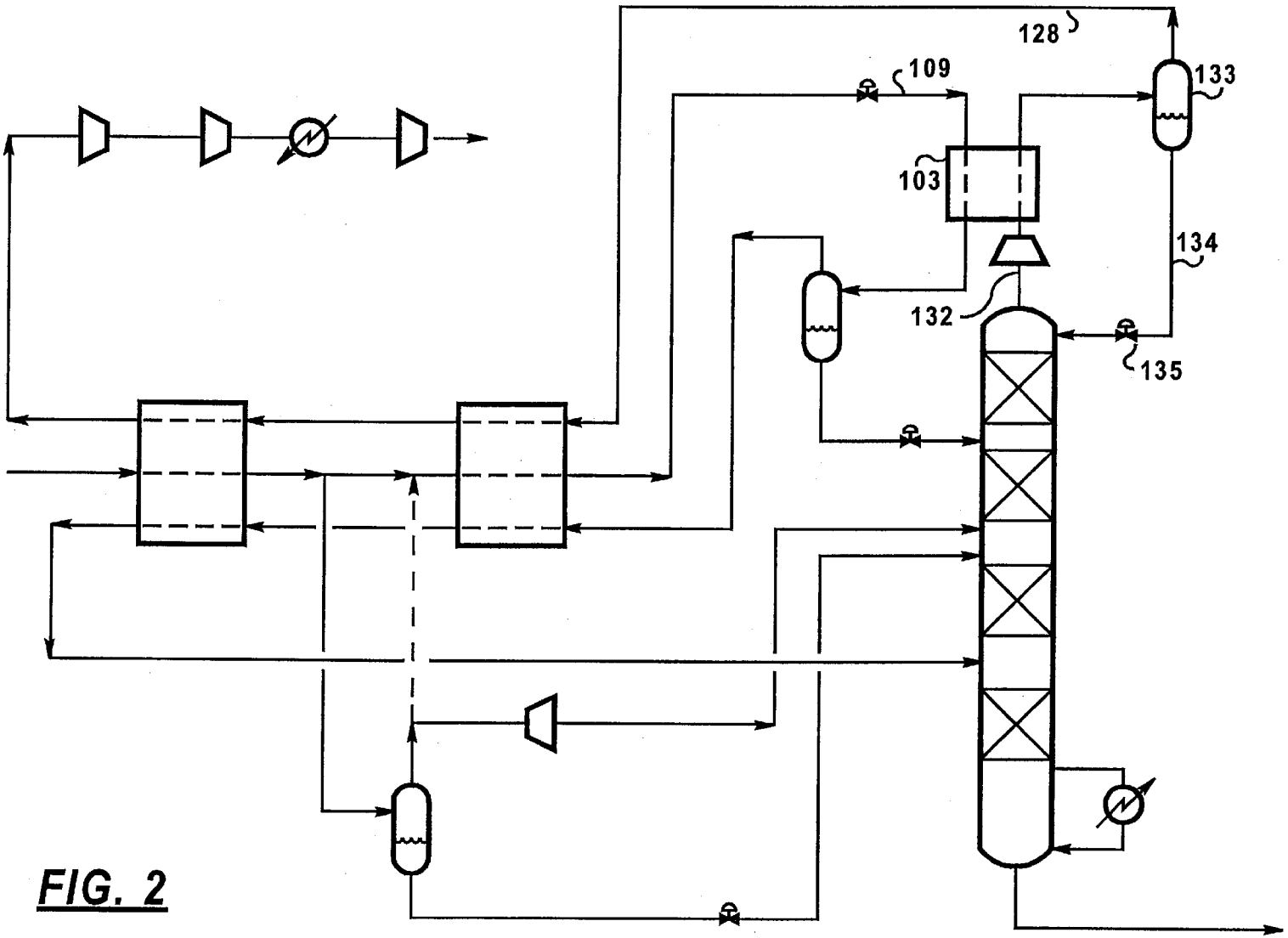
FIG. 2 is a schematic flow diagram of a second exemplary embodiment of the present invention for light hydrocarbon separation.

The invention is further illustrated by the example embodiment of FIG. 2, which is a modification of the process described above in connection with FIG. 1. The embodiment of FIG. 2 is particularly well-suited for maximizing the recovery of ethane with high methane rejection. In this example embodiment, overhead vapor stream 132 is compressed to a pressure sufficient for condensation, partially condensed in heat exchanger 103 by indirect heat exchange with stream 109, and separated in separator 133. Reflux stream 134 is reduced in pressure across valve 135 and returned to the distillation column. In an alternative of this embodiment (not shown), a portion of overhead stream 132 may be withdrawn directly to provide vapor overhead stream 128 without the need for separator 133. The remaining portion of overhead stream 132 may be compressed and at least partially condensed in heat exchanger 103 to provide reflux stream 134.

Figure 3:
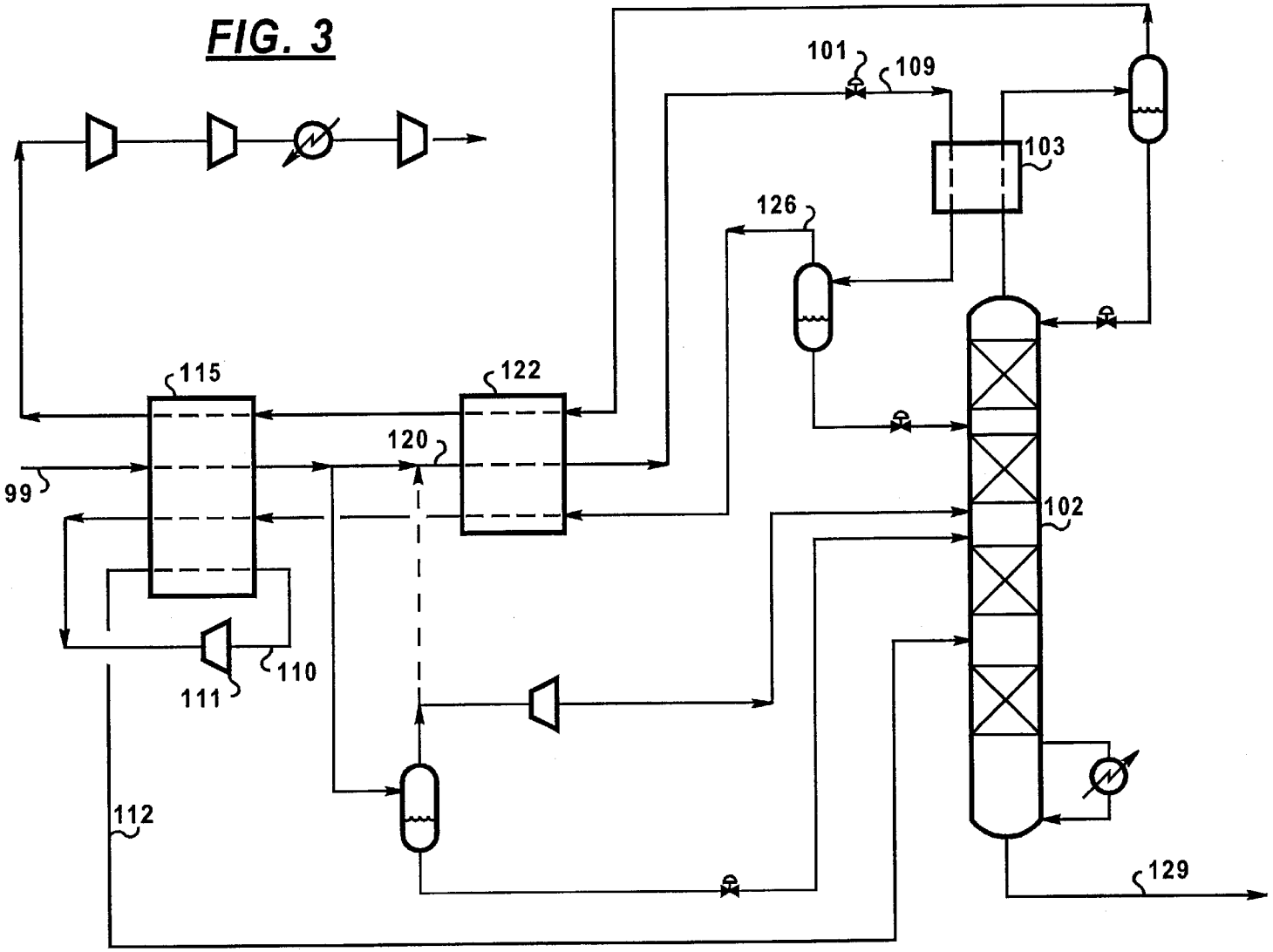
FIG. 3 is a schematic flow diagram of a third exemplary embodiment of the present invention for light hydrocarbon separation.

Another illustration of the invention is given by the example embodiment of FIG. 3, which is another modification of the process described above in connection with FIG. 1. The embodiment of FIG. 3 is particularly well-suited for high recovery of propane. In this embodiment, stream 109, after pressure reduction across valve 101, is vaporized in heat exchanger 103 at a pressure significantly higher than that of distillation column 102. Resultant vapor stream 126 is warmed in heat exchangers 115 and 122 to provide cooling to streams 99 and 120 as earlier described, and the resulting warmed stream is work expanded in expander 111. Expanded and cooled stream 110 is warmed in heat exchanger 115 to provide additional cooling for streams 99 and 120. Warmed, expanded stream 112 is introduced into distillation column 102. By vaporizing stream 109 at an elevated pressure in reflux exchanger 103, and by expanding the warmed vapor from heat exchanger 115, the overall efficiency of the process may be increased.

Figure 4:
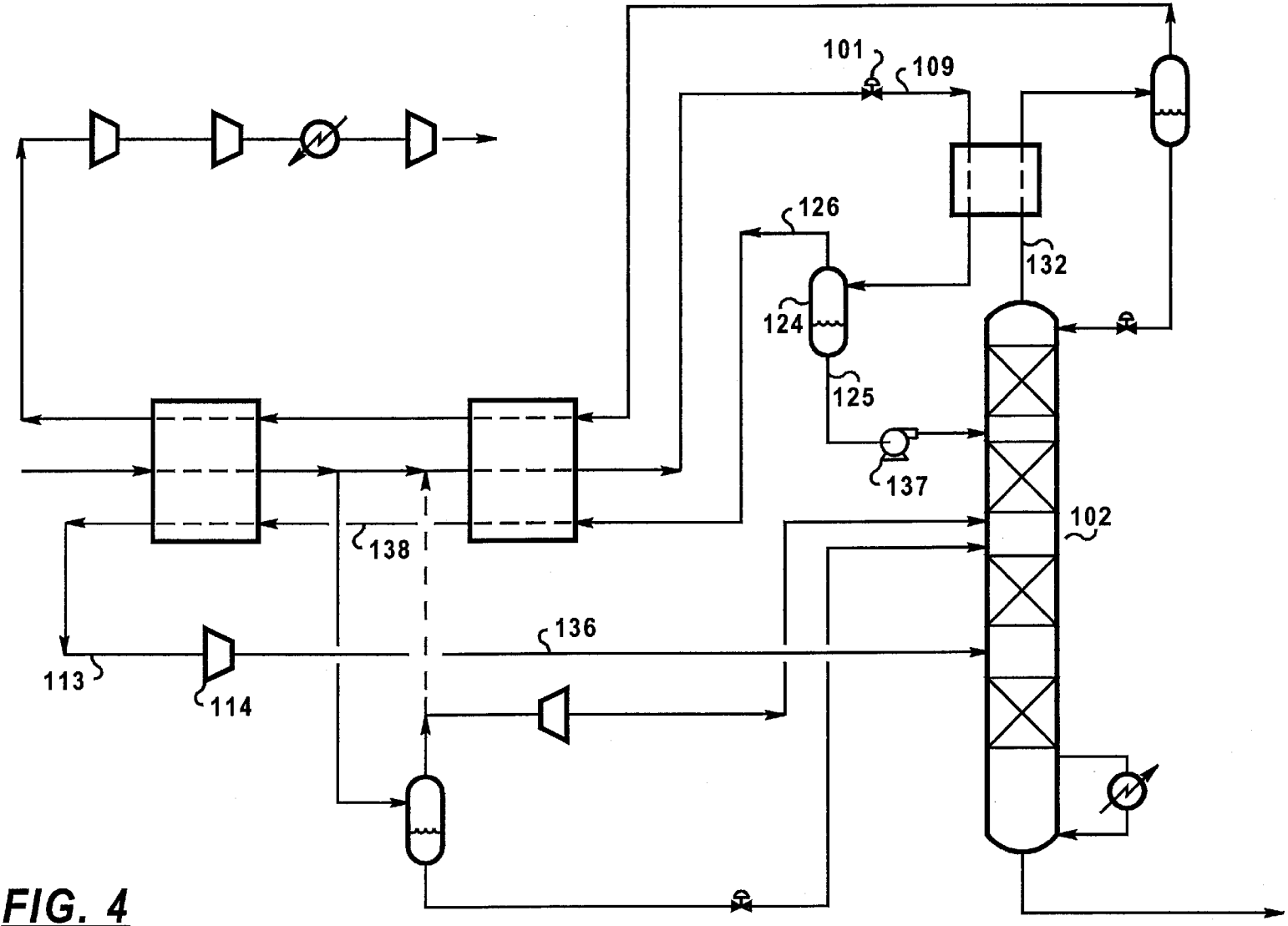
FIG. 4 is a schematic flow diagram of a fourth exemplary embodiment of the present invention for light hydrocarbon separation.

The invention is further illustrated by the example embodiment of FIG. 4, which is a modification of the process described above in connection with FIG. 2. This example embodiment is particularly well-suited for maximizing the recovery of ethane with high methane rejection. Referring to FIG. 4, stream 109 is vaporized at a pressure significantly lower than that of distillation column 102. Resultant vapor stream 126 from separator 124 is warmed to provide cooling to streams 99 and 120 as described earlier, warmed stream 113 is compressed in compressor 114, and compressed stream 136 is introduced into distillation column 102. Alternatively, instead of compressing warmed stream 113 as shown, either stream 126 of stream 138 can be compressed (not shown). By boiling stream 109 at a reduced pressure, its boiling temperature is low enough to provide refrigeration necessary to condense overhead vapor stream 132. In this embodiment liquid stream 125 is pressurized by pump 137 and introduced into distillation column 102.

EXAMPLE

The following Example illustrates but does not limit the present invention. Referring to the embodiment of FIG. 1, natural gas feed stream 99 is obtained at a pressure of 908 psia and a temperature of 84° F. The feed stream has a composition in mole % of 0.10% nitrogen, 89.34% methane, 6.34% ethane, 2.96% propane, 0.49% isobutane, 0.52% butane, 0.15% isopentane, and 0.10% pentane. The pressure of the product residue gas from compressor system 130 is 1090 psia, 98% of the propane in feed stream 99 is recovered in bottoms product stream 129, and the ethane concentration in the bottoms product stream 129 is less than 5 mole %. Distillation column 102 utilizes 28 theoretical stages (either trays or structured packing), the minimum approach in all heat exchangers is 3° F., all compression stages operate at 80% isentropic efficiency, and expander 117 operates at an isentropic efficiency of 85%.

Figure 5:
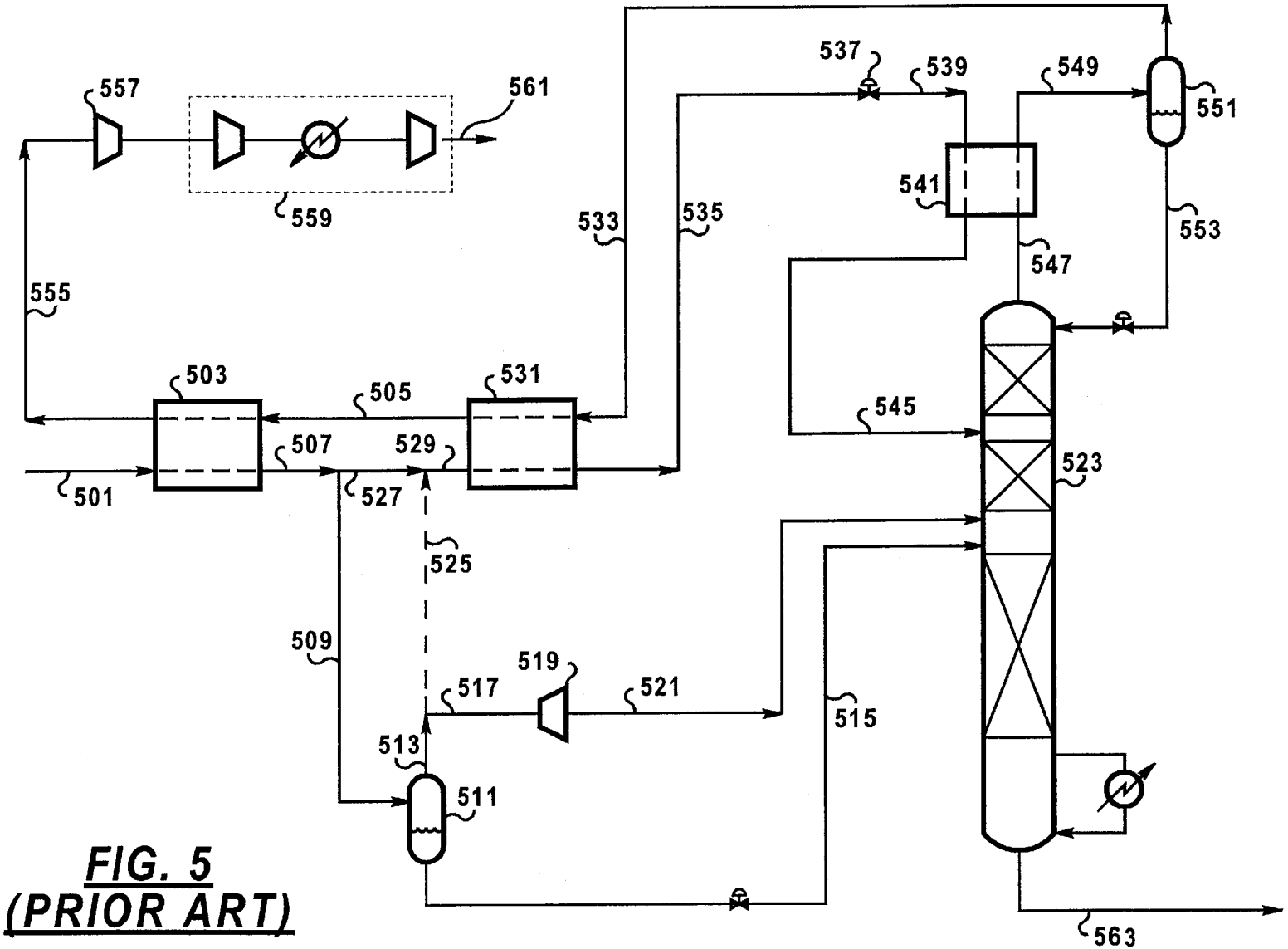
FIG. 5 (PRIOR ART)
FIG. 5 is a schematic flow diagram of a prior art method for light hydrocarbon separation.

This embodiment of the present invention was compared with the process of FIG. 5, which is a known process of the prior art described earlier. In FIG. 5, feed gas 501 is cooled and partially condensed in heat exchanger 503 against cold process stream 505 to yield cooled feed stream 507. A portion of stream 507 is taken as stream 509 into separator 511, from which vapor stream 513 and liquid stream 515 are withdrawn. A portion of vapor stream 513 is withdrawn as vapor stream 517, work expanded in expander 519, and expanded stream 521 is introduced into distillation column 523.

The remaining portion of stream 513, stream 525, is combined with the remainder of stream 507, stream 527, to yield stream 529. Stream 529 is further cooled in exchanger 531 against cold process stream 533 to yield cooled partially-condensed feed stream 535. Stream 535 is flashed across valve 537 and flashed stream 539 is warmed and vaporized in reflux exchanger 541. Vapor stream 545 is introduced directly into the rectification section of distillation column 523. Overhead vapor stream 547 is partially condensed in reflux exchanger 541, and partially condensed stream 549 is separated into cold vapor product stream 533 and reflux liquid stream 553, which is returned to distillation column 523.

Vapor product stream 533, which is the cold process stream described above, is warmed in heat exchangers 531 and 503 as earlier described to yield warmed vapor product or residual gas stream 555. Stream 555 is compressed in compressor 557, which is driven (not shown) by expander 519, and is further compressed in compression system 559 to yield residual gas product stream 561. Bottoms product stream 563 is withdrawn from distillation column 523.

Process simulations were carried out for the present invention as embodied in FIG. 1 and described earlier, and also for the prior art process embodied in FIG. 5. The process parameters described above with respect to FIG. 1 were used for the simulation of both FIG. 1 and FIG. 5. In the process of FIG. 1, stream 127 of FIG. 1 was warmed to a temperature near that of the incoming feed before being introduced to the distillation column. Both processes were simulated rigorously and all adjustable process operating parameters were chosen to minimize the power required for a fixed feed flow rate. For both the present invention of FIG. 1 and the conventional process of FIG. 5, an additional reboiler at an intermediate location (not shown) was added to the distillation column to improve efficiency.

A summary of the results of the simulation are given in Table 1 below.

TABLE 1

Summary of Results for Example 1

| | Present Invention (FIG. 1) | Conventional Process (FIG. 5) |
|---|---|---|
| Distillation column pressure, psia (102 of FIG. 1; 523 of FIG. 5) | 459 | 377 |
| Relative reflux condenser duty (duty of 541 in FIG. 5)/(duty of 103 in FIG. 1) | 1.00 | 1.38 |
| Relative power requirement (power of 559 in FIG. 5)/ (power of 130 in FIG. 1) | 1.00 | 1.19 |

The distillation column of the present invention can be operated at a higher pressure than that of the conventional process, thus requiring less compression of the final residual gas product stream. Also, less reflux duty is required for the invention as a result of lower vapor flow into the rectification section of the distillation column. These advantages are realized in the present invention because the vapor formed in providing refrigeration to the distillation column reflux condenser is warmed and introduced into the stripping section of the column, rather than following a conventional approach in which the vapor so formed is introduced directly into the rectification section of the column.

These comparative results show that the efficiency of the present invention is significantly better than that of the conventional process of FIG. 5, with little added cost and complexity.

What is claimed is:

1. A method for the separation of a pressurized hydrocarbon mixture containing at least one more volatile component and at least one less volatile component, which method comprises (a) cooling and partially condensing the hydrocarbon mixture to form a two-phase hydrocarbon mixture, and separating a first portion of the two-phase hydrocarbon mixture into a first hydrocarbon vapor and a first hydrocarbon liquid;

(b) work expanding at least a portion of the first hydrocarbon vapor to provide a cooled, expanded hydrocarbon vapor and introducing the cooled, expanded hydrocarbon vapor into a distillation column at a first column location;

(c) reducing the pressure of the first hydrocarbon liquid to provide a reduced-pressure hydrocarbon liquid and introducing the reduced-pressure hydrocarbon liquid into the distillation column at a second column location; and (d) withdrawing an overhead vapor enriched in the more volatile component from the distillation column; cooling, partially condensing, and separating the overhead vapor to provide a condensed overhead liquid and an uncondensed vapor overhead, introducing the condensed overhead liquid into the distillation column as reflux, and withdrawing from the bottom of the distillation column a stream enriched in the less volatile component;

wherein cooling and partial condensing of the overhead vapor in (d) is effected by (1) further cooling a second portion of the two-phase hydrocarbon mixture to provide a further cooled hydrocarbon mixture;

(2) reducing the pressure of the further cooled hydrocarbon mixture to provide a reduced-pressure hydrocarbon mixture; and (3) utilizing the reduced-pressure hydrocarbon mixture to provide by indirect heat exchange the cooling and partial condensing of the overhead vapor; and wherein cooling and partial condensing of the overhead vapor by indirect heat exchange with the reduced-pressure hydrocarbon mixture in (3) provides a warmed, two-phase hydrocarbon mixture, the warmed, two-phase hydrocarbon mixture is separated into a second hydrocarbon liquid and a second hydrocarbon vapor, the second hydrocarbon liquid is introduced into the distillation column, and the second hydrocarbon vapor is warmed and introduced into the distillation column at a third column location below the first column location of (b).

2. The method of claim 1 wherein the cooling of the second portion of the two-phase hydrocarbon mixture of (1) is effected in part by indirect heat exchange with the second hydrocarbon vapor to provide a warmed second hydrocarbon vapor.

3. The method of claim 2 wherein the cooling and partial condensing of the hydrocarbon mixture in (a) is effected in part by indirect heat exchange with the warmed second hydrocarbon vapor to yield a further warmed second hydrocarbon vapor which is introduced into the distillation column at the third column location which is below the first column location of (b).

4. The method of claim 3 wherein the third column location is below the second column location.

5. The method of claim 1 which further comprises combining a portion of the first hydrocarbon vapor of (a) with the second portion of the two-phase hydrocarbon mixture of prior to further cooling.

6. The method of claim 1 wherein the cooling of the second portion of the two-phase hydrocarbon mixture of (1) is effected in part by indirect heat exchange with the uncondensed vapor overhead of (d) to provide a warmed uncondensed vapor overhead.

7. The method of claim 6 wherein the cooling and partially condensing of the hydrocarbon mixture in (a) is effected in part by indirect heat exchange with the warmed uncondensed vapor overhead.

8. The method of claim 1 wherein the overhead vapor enriched in the more volatile component withdrawn from the distillation column in (d) is compressed prior to cooling and partially condensing, and the partially-condensed overhead is reduced in pressure prior to introduction into the distillation column as reflux.

9. The method of claim 1 wherein the second hydrocarbon vapor is work expanded after warming and prior to introduction into the distillation column.

10. The method of claim 1 wherein the pressure of the reduced-pressure hydrocarbon mixture of (2) is lower than the pressure in the distillation column.

11. The method of claim 10 wherein the second hydrocarbon liquid is pumped and pressurized prior to introduction into the distillation column.

12. The method of claim 11 wherein the second hydrocarbon vapor is compressed prior to being introduced into the distillation column.

13. The method of claim 1 wherein the hydrocarbon mixture comprises methane and one or more hydrocarbons containing two or more carbon atoms.

14. The method of claim 13 wherein the hydrocarbon mixture also contains nitrogen.

15. The method of claim 13 wherein the hydrocarbon mixture is natural gas.

16. A method for the separation of a pressurized hydrocarbon mixture containing at least one more volatile component and at least one less volatile component, which method comprises (a) cooling and partially condensing the hydrocarbon mixture to form a two-phase hydrocarbon mixture, and separating a first portion of the two-phase hydrocarbon mixture into a first hydrocarbon vapor and a first hydrocarbon liquid;

(b) work expanding at least a portion of the first hydrocarbon vapor to provide a cooled, expanded hydrocarbon vapor and introducing the cooled, expanded hydrocarbon vapor into a distillation column at a first column location;

(c) reducing the pressure of the first hydrocarbon liquid to provide a reduced-pressure hydrocarbon liquid and introducing the reduced-pressure hydrocarbon liquid into the distillation column at a second column location; and (d) withdrawing an overhead vapor enriched in the more volatile component from the distillation column, compressing a portion of the overhead vapor to yield a compressed overhead vapor, cooling the compressed overhead vapor to provide a cooled and at least partially condensed overhead stream, reducing the pressure of the cooled and at least partially condensed overhead stream to provide a reduced-pressure overhead stream, introducing the reduced-pressure overhead stream into the distillation column as reflux, and withdrawing from the bottom of the distillation column a stream enriched in the less volatile component;

wherein cooling of the compressed overhead vapor in (d) is effected by (1) further cooling a second portion of the two-phase hydrocarbon mixture to provide a further cooled hydrocarbon mixture;

(2) reducing the pressure of the further cooled hydrocarbon mixture to provide a reduced-pressure hydrocarbon mixture; and (3) utilizing the reduced-pressure hydrocarbon mixture to provide by indirect heat exchange the cooling of the compressed overhead vapor;

and wherein cooling of the compressed overhead vapor by indirect heat exchange with the reduced-pressure hydrocarbon mixture in (3) provides a warmed, two-phase hydrocarbon mixture, the warmed, two-phase hydrocarbon mixture is separated into a second hydrocarbon liquid and a second hydrocarbon vapor, the second hydrocarbon liquid is introduced into the distillation column, and the second hydrocarbon vapor is warmed and introduced into the distillation column at a third column location below the first column location of (b).

* * * * *